US007322305B2

(12) United States Patent
Fujihara

(10) Patent No.: US 7,322,305 B2
(45) Date of Patent: Jan. 29, 2008

(54) NEEDLE BAR THREAD GUIDE FOR SEWING MACHINE

(75) Inventor: Shinya Fujihara, Ichinomiya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/647,330

(22) Filed: Dec. 29, 2006

(65) Prior Publication Data

US 2007/0163478 A1 Jul. 19, 2007

(30) Foreign Application Priority Data

Jan. 19, 2006 (JP) ..... 2006-010966

(51) Int. Cl.
*D05B 55/00* (2006.01)
*D05B 87/00* (2006.01)

(52) U.S. Cl. ..... 112/302; 112/225

(58) Field of Classification Search ..... 112/302, 112/224, 225, 259, 235, 237–239
See application file for complete search history.

(56) References Cited

U.S. PATENT DOCUMENTS 2,691,951 A * 10/1954 Hansen ..... 112/302
3,040,681 A * 6/1962 Kastrup ..... 112/302
4,215,641 A * 8/1980 Dobrjanskyj et al. ..... 112/278
4,248,169 A 2/1981 Giaimo et al.
4,936,234 A * 6/1990 Jimenez et al. ..... 112/259
5,642,678 A * 7/1997 Mizunuma et al. ..... 112/302
6,918,344 B2 * 7/2005 Ebata et al. ..... 112/225
7,197,995 B2 * 4/2007 Hayashi et al. ..... 112/225

FOREIGN PATENT DOCUMENTS

JP A 2004-236673 8/2004
JP A 2006-034557 2/2006

* cited by examiner

*Primary Examiner*—Ismael Izaguirre
(74) *Attorney, Agent, or Firm*—Oliff & Berridge, PLC

(57) ABSTRACT

A needle bar thread guide for a sewing machine includes a thread guide part located in a thread hooking part of a thread hooking member to guide the needle thread into the thread hooking part, and a thread cast-off preventing member having a thread cast-off preventing part closing the thread guide part. The thread cast-off preventing member is elastically deformable. The thread cast-off preventing part has a distal end which is in contact with an upper surface of the thread hooking part.

6 Claims, 10 Drawing Sheets

NEEDLE BAR THREAD GUIDE FOR SEWING MACHINE

CROSS-REFERENCE TO RELATED APPLICATIONS

This application is based upon and claims the benefit of priority from the prior Japanese Patent Application No. 2006-10966 filed on Jan. 19, 2006, the entire contents of which are incorporated herein by reference.

BACKGROUND

1. Field

The present disclosure relates to a needle bar thread guide fixed to a lower end of a needle bar of a sewing machine.

2. Description of the Related Art

Sewing machines have conventionally been provided with a needle bar thread guide which is fixed to a lower end of a needle bar to guide a needle thread caught on a needle thread take-up to an eye of a sewing needle along the needle bar. An operator causes a needle thread to pass through the needle bar thread guide before sewing, so that the needle thread can be prevented from uselessly swinging near the lower end of the needle when the needle bar is moved up and down. Then, the needle thread can easily be passed through the needle bar thread guide fixed to the lower end of the needle bar. Moreover, various proposed types of needle bar thread guides can keep the needle thread caught by the needle bar thread guide so that the needle thread is not easily detached.

JP-A-2004-236673 discloses, as a conventional example, a needle bar thread guide for a sewing machine, which comprises an upper first needle bar thread guide and a lower second needle bar thread guide both formed integrally with each other substantially into a reversed C-shape so that a needle bar connecting stud is clamped between the needle bar thread guides. The first needle bar thread guide includes a first thread guiding part formed in a right half thereof into a curved shape and a first threading part formed in a left half thereof so as to be retreated rearward. The second needle bar thread guide includes a second thread guiding part inclined obliquely rearward and extending horizontally and a second threading part continuous to the second thread guiding part.

According to the conventional construction, when the needle bar thread guide is to be threaded with a needle thread by a threading mechanism, the needle thread is caused to pass through the first thread guide part to be caught on the first threading part, whereby the first threading part is threaded. The needle thread is then guided rearward by the second thread guiding part of the second needle bar thread guide thereby to be caught on the second threading part, whereby the second threading part is threaded. In this case, the first and second thread guiding parts intersect with each other. Accordingly, when the first and second threading parts have been threaded with the needle thread, the needle thread cannot easily be detached from the first and second thread guiding parts.

In the above-described conventional example, however, the first thread guiding part protrudes forward relative to the second needle bar thread guide, and moreover, the first and second threading parts have opening directions different from each other. Accordingly, although the needle thread cannot easily disengage from the first and second thread guiding parts, the first needle bar thread guide having the first thread guiding part is vertically spaced away from the second needle bar thread guide having the second thread guiding part with the needle bar connecting stud being clamped therebetween. As a result, when the needle thread hops or jumps while being moved from the needle thread take-up toward the needle eye during sewing, thereby swinging widely, there is a low possibility that the needle thread may disengage from the needle bar thread guide.

Meanwhile, since the first thread guiding part of the first needle bar thread guide protrudes forward relative to the second needle bar thread guide, the needle bar thread guide cannot be threaded only by moving the needle thread linearly leftward when the operator manually threads the needle bar thread guide without using the threading mechanism. In this case, the needle thread needs to be moved leftward for the threading purpose while being circled forward in a large way. Thus, the threading operation is troublesome and the sewing machine lacks in the operability. Moreover, when the needle thread is to be disengaged from the needle bar thread guide, an operation reverse to the threading operation needs to be carried out, whereupon the sewing machine also lacks in the operability regarding an operation of unthreading the needle bar thread guide.

SUMMARY

Therefore, an object of the present disclosure is to provide a needle bar thread guide for a sewing machine, which can easily be threaded with the needle thread, can prevent the needle thread from disengaging therefrom and can easily be unthreaded.

The present disclosure provides a needle bar thread guide for a sewing machine which includes a needle bar supporting a sewing needle with a lower end and a thread hooking member provided on the lower end of the needle bar to hook a needle thread, the thread hooking member including a thread hooking part with an upper surface. The needle bar thread guide comprises a thread guide part provided in the thread hooking part of the thread hooking member to guide the needle thread into the thread hooking part, and a thread cast-off preventing member having a thread cast-off preventing part closing the thread guide part, the thread cast-off preventing member being elastically deformable, the thread cast-off preventing part having a distal end which is in contact with the upper surface of the thread hooking part.

In the above-described construction, the thread guide part of the thread hooking member is closed by the thread cast-off preventing part of the thread cast-off preventing member. Moreover, although the distal end of the thread cast-off preventing part is in contact with the upper surface of the thread hooking part, the thread cast-off preventing member is elastically deformable when the operator moves the needle thread extending from a needle thread take-up toward a needle eye through the thread guide part to the thread hooking part so that the needle thread is hooked by the thread hooking part. Accordingly, the distal end of the thread cast-off preventing part is easily raised against the elastic force due to the movement of the needle thread. Consequently, the needle thread can be moved into the thread guide part, avoiding the thread cast-off preventing part. The needle thread can further be hooked by the thread hooking part, having passed through a space between the thread guide part and the upper surface of the thread hooking part, whereupon the thread hooking work by the operator can greatly be simplified. Thus, the needle thread can easily be hooked on the needle bar thread guide.

Furthermore, in the case where sewing starts while the needle thread is hooked on the thread hooking part, the distal end of the thread cast-off preventing part is normally in contact with the upper surface of the thread hooking part even when the needle thread hops or jumps while being moved from the needle thread take-up toward the needle eye during sewing, thereby swinging widely. Accordingly, the needle thread cannot disengage outward from the thread hooking part and accordingly, the needle thread can reliably be prevented from disengaging from the needle bar thread guide.

Additionally, when the needle thread is detached from the thread hooking part, the distal end of the thread cast-off preventing part is easily raised against the elastic force due to the movement of the needle thread, so that the needle thread passes through the distal end of the thread cast-off preventing part thereby to avoid the part. Consequently, since the needle thread is disengaged, the thread disengaging work to be carried out by the operator can be simplified greatly.

Furthermore, the distal end of the thread cast-off preventing part is formed so as to be curved downward and is in point-contact with the upper surface of the thread hooking part. Consequently, the distal end of the thread cast-off preventing part can easily be raised by movement of the needle thread when the thread hooking part is threaded with the needle thread by the operator. Accordingly, the threading and unthreading works can be simplified. Moreover, since only the distal end of the thread cast-off preventing part is bent, manufacture of the thread cast-off preventing member can be simplified.

Furthermore, the thread cast-off preventing member comprises a leaf spring and has a horizontal plate part continuous to the distal end of the thread cast-off preventing part, an elastically deformable rising part extending upward from the horizontal plate part and having an upper end, and a fixed plate part continuous to the upper end of the rising part. In this construction, these parts of the thread cast-off preventing member can be made integrally with one another by pressing a thin leaf spring material. Consequently, the weight of the thread cast-off preventing member can be reduced, and easiness and accuracy in the manufacture of the thread cast-off member can be improved, whereby the manufacturing cost can be reduced.

Furthermore, the horizontal plate part of the thread cast-off preventing member includes a stopper part limiting a moving range of the horizontal plate part so that the distal end of the thread cast-off preventing part is prevented from disengaging from the thread hooking part when the distal end of the thread cast-off preventing part is moved horizontally. Consequently, the moving range of the horizontal plate part can reliably be limited, and the distal end of the thread cast-off preventing member can be maintained in contact with the thread hooking part when the needle thread is hooked on or disengaged from the thread hooking part.

Additionally, the horizontal plate part has an elongate hole which is formed through the horizontal plate part so that the needle is passed through the hole, and the stopper part is comprised of an edge of the elongate hole. Consequently, the thread cast-off preventing member can easily be manufactured since only the elongate hole is formed through the horizontal plate by pressing.

BRIEF DESCRIPTION OF THE DRAWINGS

Other objects, features and advantages of the present disclosure will become clear upon reviewing the following description with reference to the accompanying drawings in which.

DETAILED DESCRIPTION

Three embodiments of the present invention will be described with reference to the accompanying drawings. The invention is applied to a household electronic sewing machine in each embodiment.

Figure 1:
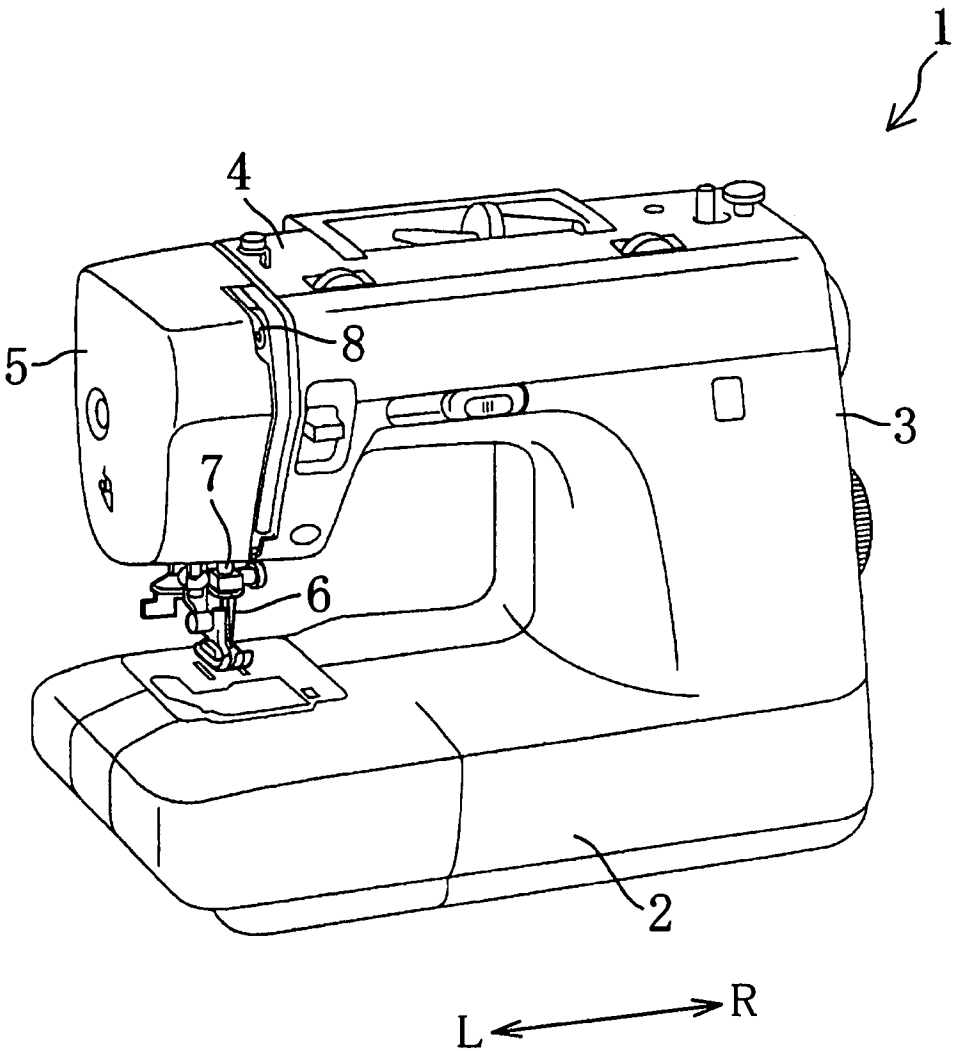
FIG. 1 is a perspective view of a lock stitch sewing machine in accordance with a first example of the present invention.

Referring firstly to FIGS. 1 to 10, a first embodiment of the invention is shown. A lock stitch sewing machine 1 comprises a sewing bed 2, a pillar 3 standing from a right end of the bed 2 and an arm 4 extending leftward from an upper end of the pillar 3 so as to be opposed to the bed 2 as shown in FIG. 1. In the arm 4 is provided a horizontally extending sewing machine main shaft (not shown) rotated by a sewing machine motor (not shown). A head 5 is mounted on a distal end of the arm 4. The head 5 includes a needle bar 7 having a lower end to which a sewing needle 6 is attached, a needle bar driving mechanism (not shown) moving the needle bar 7 vertically and a needle thread take-up driving mechanism (not shown) moving a needle thread take-up 8 vertically in synchronization with the vertical movement of the needle bar 7.

Figure 2:
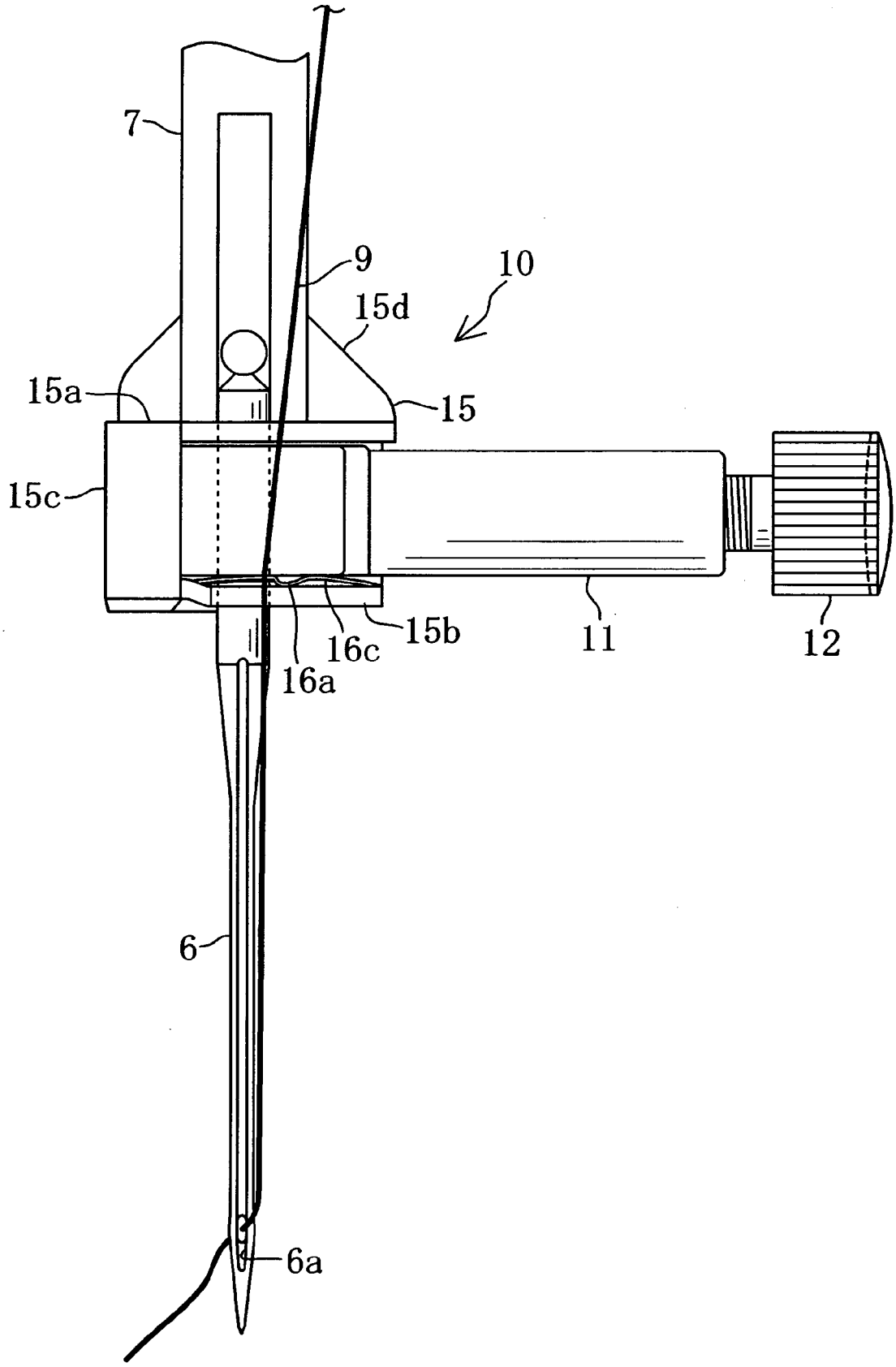
FIG. 2 is a front view of a needle bar connecting stud and a needle bar thread guide of the lock stitch sewing machine.
Figure 3:
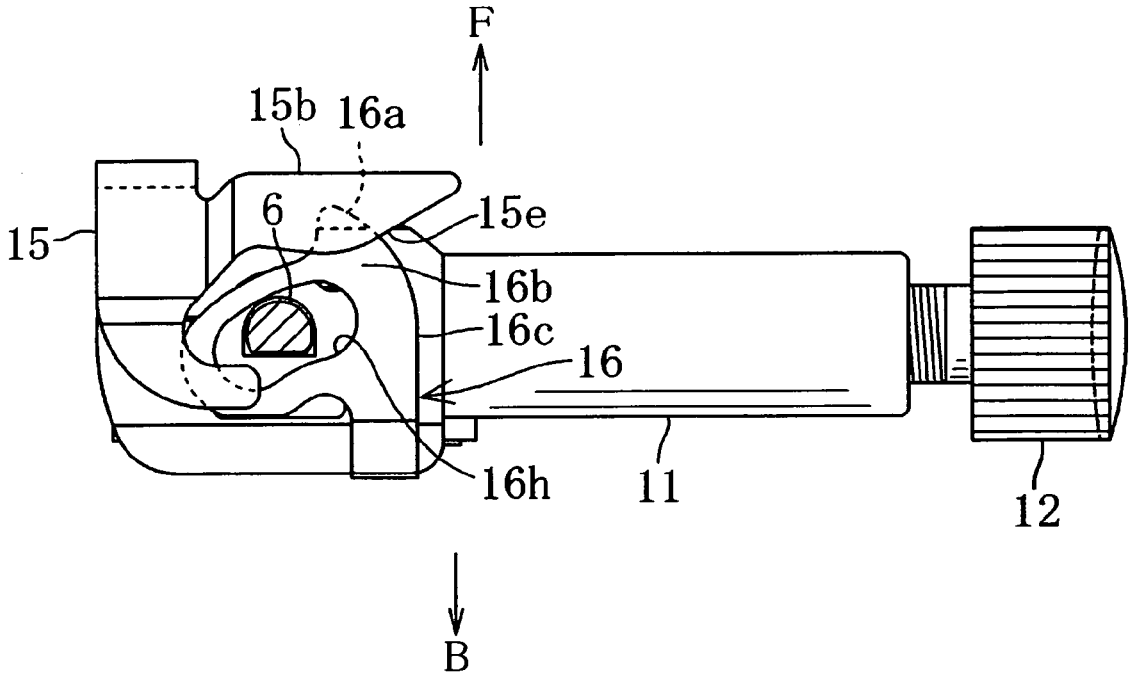
FIG. 3 is a bottom view of the needle bar connecting stud and the needle bar thread guide of the lock stitch sewing machine.
Figure 4:
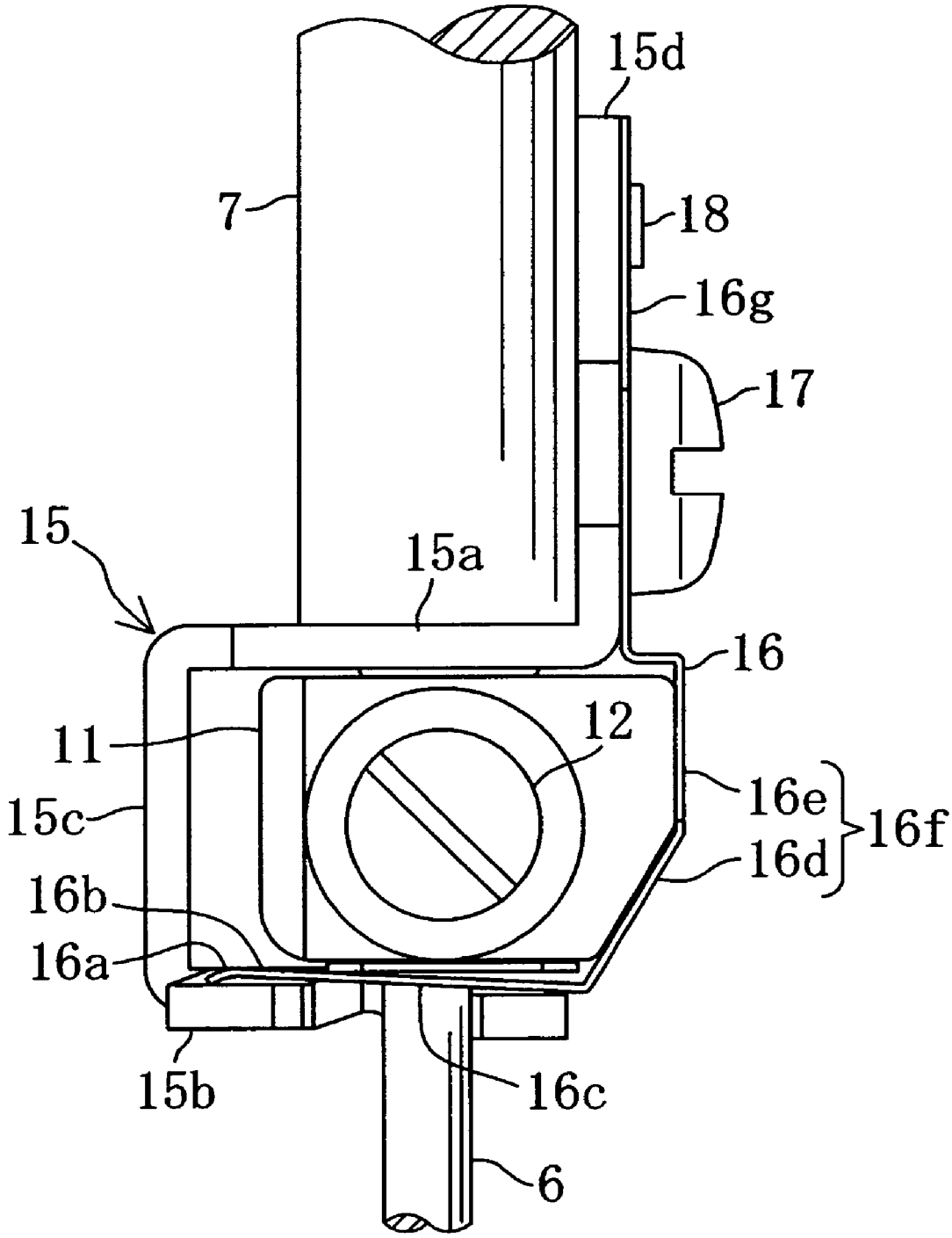
FIG. 4 is a right side view of the needle bar connecting stud and the needle bar thread guide of the lock stitch sewing machine.

The following will describe a needle bar thread guide 10 provided on the lower end of the needle bar 7. As shown in FIGS. 2 to 4, a needle bar connecting stud 11 is mounted to the lower end of the needle bar 7 by a set screw 12. The needle bar connecting stud 11 detachably fixes the sewing needle 6 to the needle bar 7. The needle bar thread guide 10 includes a thread hooking member 15 and a thread cast-off preventing member 16. The thread hooking member 15 is fixed to the lower end of the needle bar 7 so as to sandwich the needle bar connecting stud 11 between upper and lower parts thereof. The thread hooking member 15 includes a thread guiding part 15*e* which is closed by the thread cast-off preventing member 16.

The thread hooking member 15 includes a horizontal holding plate 15*a* located at the upper side of the needle bar connecting stud 11 and a horizontal thread hooking part 15*b* located at the lower side of the needle bar connecting stud 11. The holding plate 15*a* and the thread hooking part 15*b* are formed integrally with each other with a connecting plate part 15*c* being interposed therebetween. The thread hooking member 15 is fixed to the needle bar 7 by a locking screw 17 with a fixing plate part 15*d* being interposed therebetween.

Figure 9A:
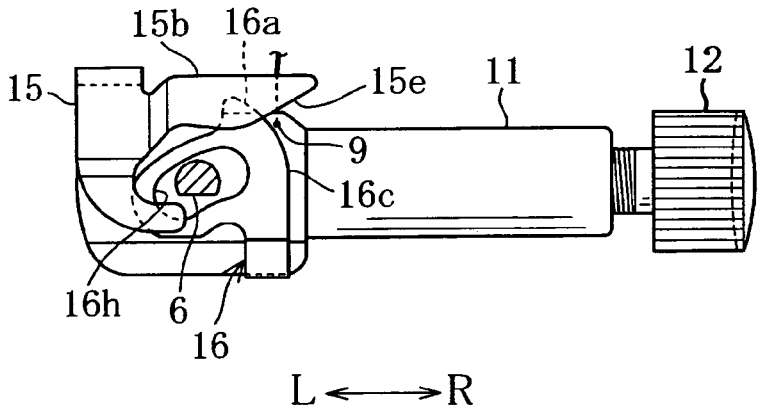
FIG. 9A is a view similar to FIG. 3, showing the condition in the case where the thread hooking starts.
Figure 9B:
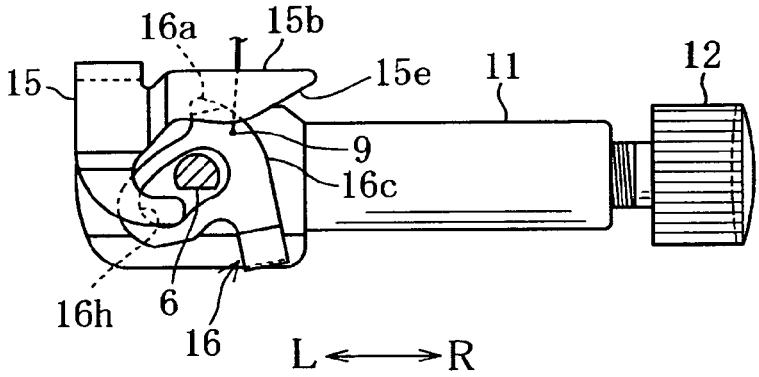
FIG. 9B is a view similar to FIG. 3, showing the condition in the case where the thread hooking is under execution.
Figure 9C:
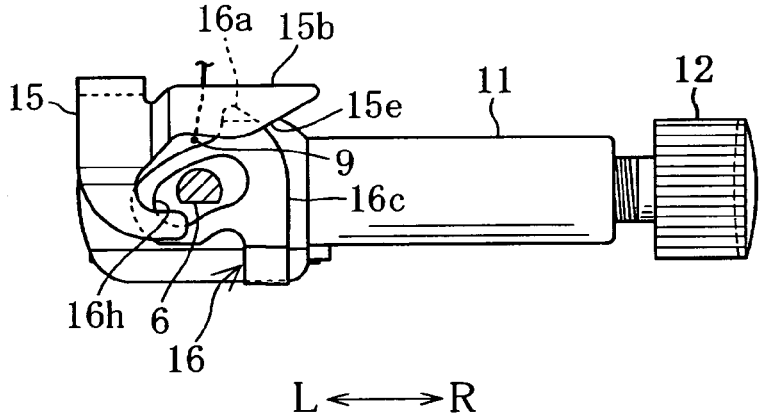
FIG. 9C is a view similar to FIG. 3, showing the condition in the case where the thread hooking has been completed.

The thread hooking part 15*b* is formed so as to protrude both forward (in the direction of arrow F) relative to the needle bar connecting stud 11 and rightward. A thread guide part 15*e* guiding the needle thread 9 is formed on the rear of the distal end (right end) of the thread hooking part 15*b*. Accordingly, when the needle thread 9 is to be hooked on the needle bar thread guide 10, the needle thread 9 guided by the thread guide part 15*e* as shown in FIG. 9A is moved through the thread guide 15*e* to a rear edge of the thread hooking part 15*b*, thereby engaging the rear edge as shown in FIG. 9C.

The thread cast-off preventing member 16 comprises an elastically deformable leaf spring which is generally thin, as shown in FIGS. 3 to 8. The thread cast-off preventing member 16 includes a horizontal plate part 16*c* disposed between a lower end of the needle bar connecting stud 11 and the thread hooking member 15 and having a thread cast-off preventing part 16*b*, an elastically deformable rising part 16*f* extending upward from a rear end of the horizontal plate part 16*a* and a fixed plate part 16*g* which is continuous to an upper end of the rising part 16*f* and fixed to the needle bar 7.

The horizontal plate part 16*c* is generally formed into a j-shape and has the thread cast-off preventing part 16*b* formed on a forward distal end thereof into a slightly pointed shape. The thread cast-off preventing part 16*b* has a distal end formed with a downwardly curved distal contact part 16*a* (corresponding to a distal end of the thread cast-off preventing member 16). The distal contact part 16*a* is elastically biased downward into point-contact with an upper surface of the thread hooking part 15*b* as shown in FIG. 3.

The horizontal plate part 16*c* is formed with a substantially centrally located elongate hole 16*h* through which the needle 6 is passed. The rising part 16*f* includes a first rising part 16*d* which is continuous to a rear end and has a smaller width and a second rising part 16*e* which is continuous to the first rising part 16*d* and has a larger width. The fixed plate part 16*g* is formed so as to be continuous to an upper end of the second rising part 16*e*. The fixed plate part 16*g* is formed with an upper pin hole 16*i* and a lower screw hole 16*j*.

A rearwardly directed lock pin 18 is secured to an upper end of the fixed plate part 15*d* of the thread hooking member 15. A lock pin 18 is fitted into the pin hole 16*i* of the fixed plate part 16*g* so that the thread cast-off preventing member 16 is positioned at a predetermined height relative to the thread hooking member 15. In this state, a fixing screw 17 is inserted through the screw hole 16*j* so that the thread hooking member 15 is fixed, whereupon the thread cast-off preventing member 16 is fixed to the needle bar 7 together with the thread hooking member 15 by the fixing screw 17.

More specifically, only the distal contact part 16*a* of the horizontal plate part 16*c* is in point-contact with the upper surface of the thread hooking part 15*b*. Accordingly, a substantially whole part of the thread cast-off preventing part 16*b* except for the distal contact part 16*a* stays afloat over the upper surface of the thread hooking part 15*b*. As a result, a gap through which the needle thread 9 is passable is defined between the horizontal plate part 16*c* and the upper surface of the thread hooking part 15*b*.

Figure 5:
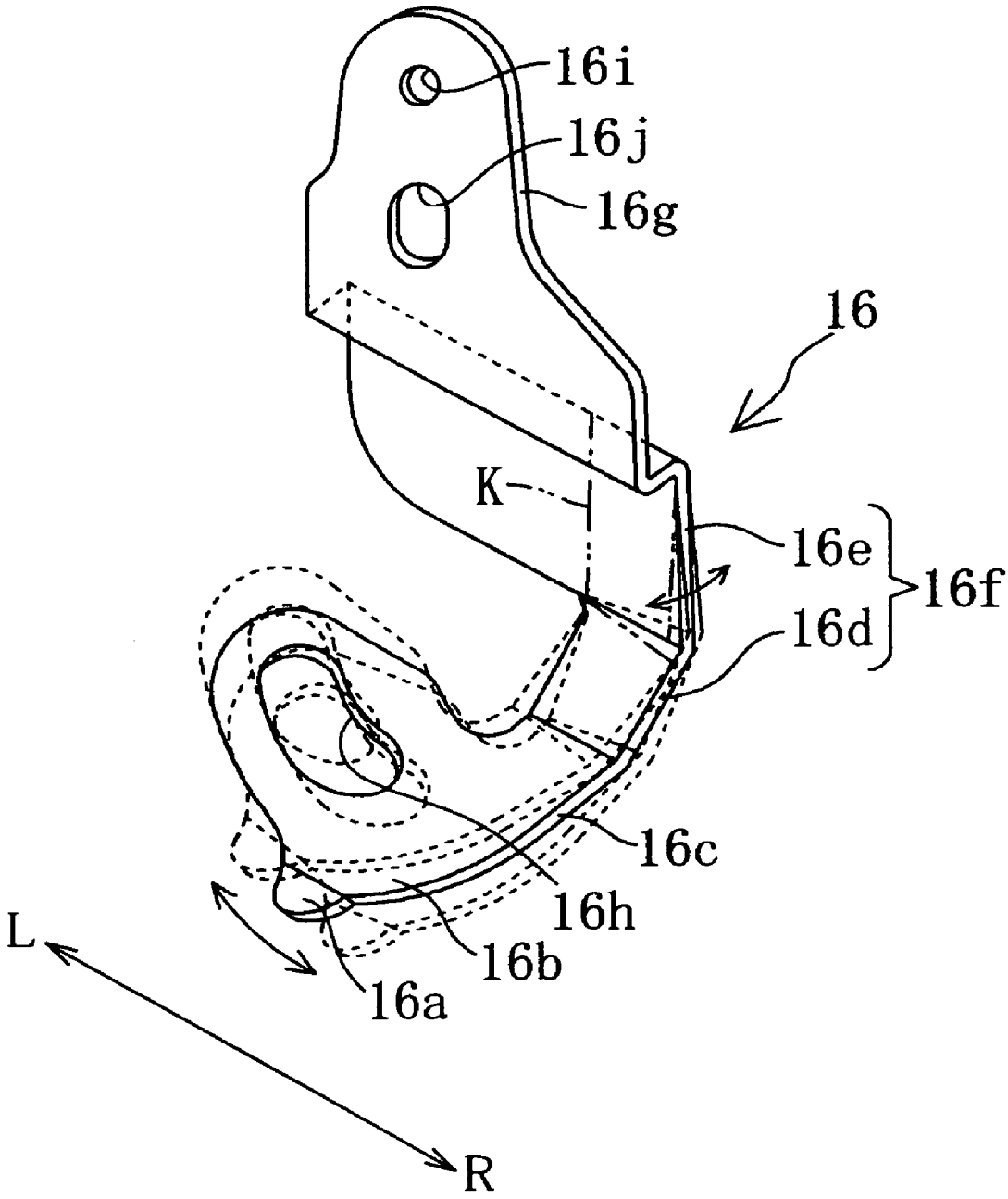
FIG. 5 is a perspective of a thread cast-off preventing member of the lock stitch sewing machine.
Figure 6:
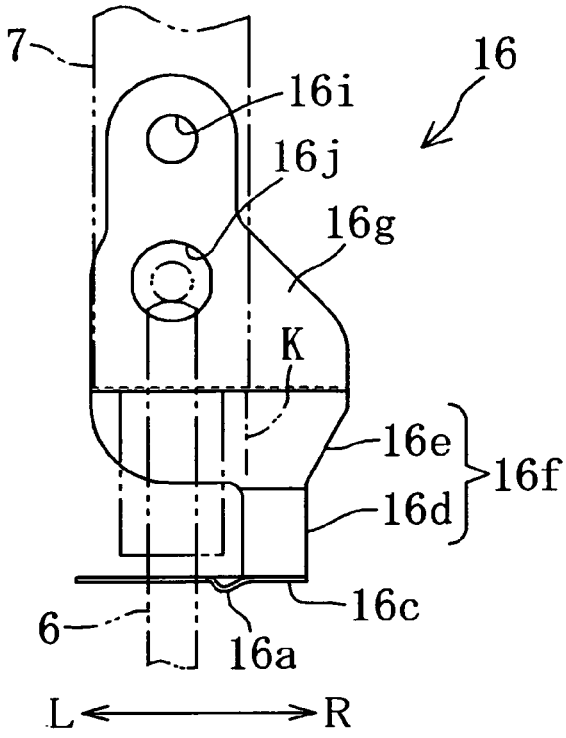
FIG. 6 is a front view of the thread cast-off preventing member.
Figure 7:
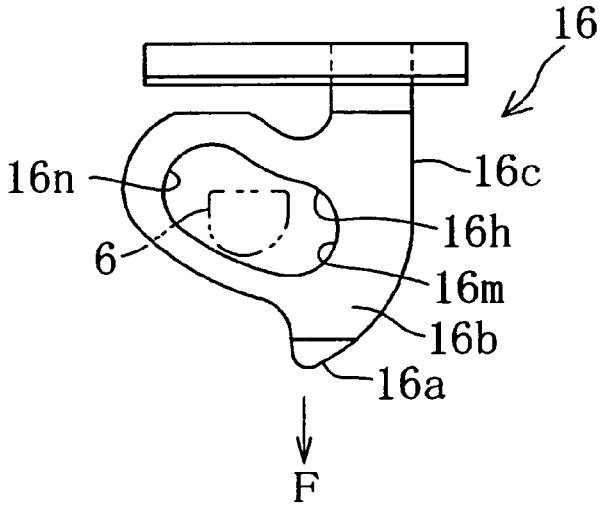
FIG. 7 is a plan view of the thread cast-off preventing member.
Figure 8:
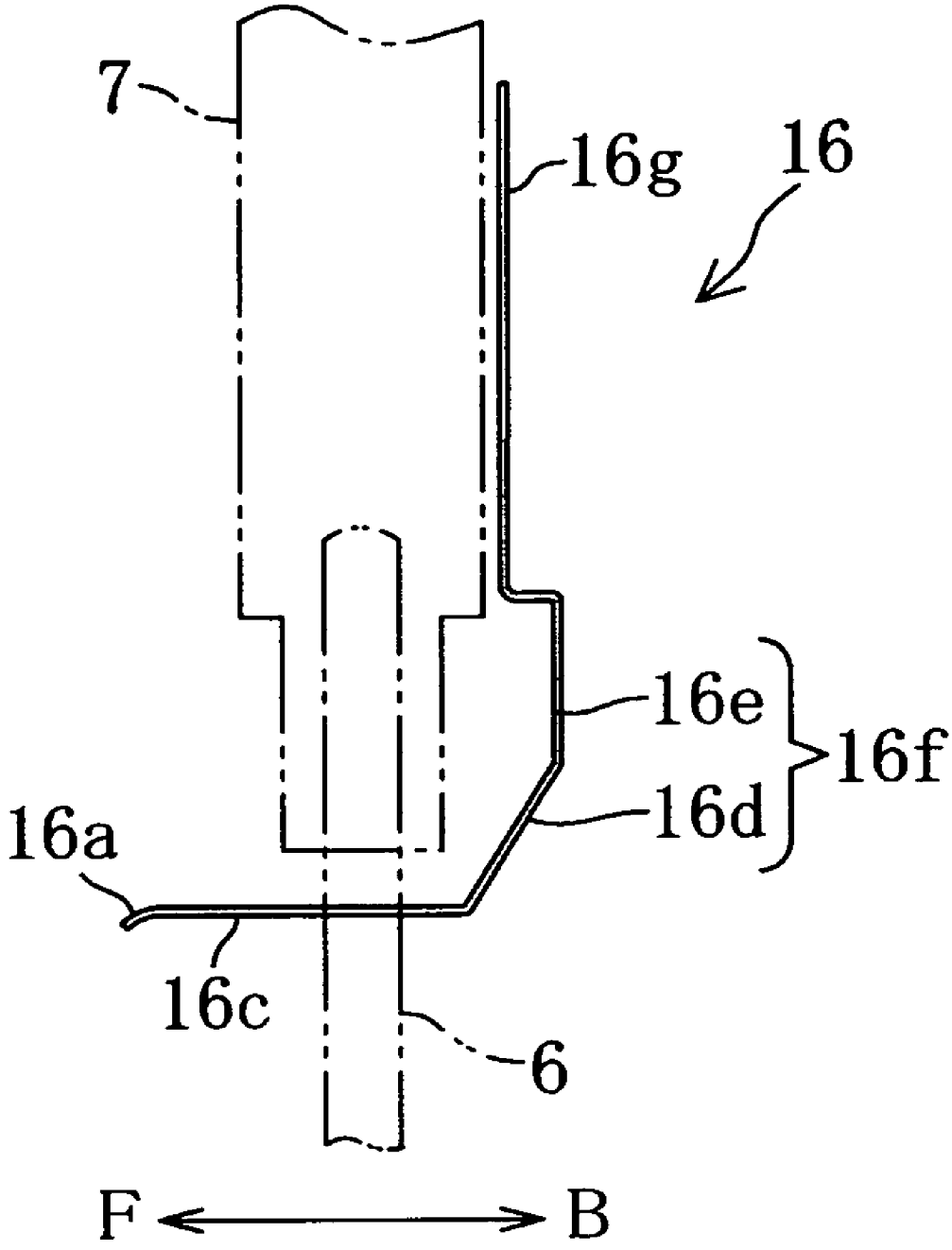
FIG. 8 is a right side view of the thread cast-off preventing member.

On one hand, the thread cast-off preventing member 16 comprises the thin leaf spring and has the narrow first rising part 16*d*. Accordingly, the horizontal plate part 16*c* is rotatively moved by elastic deformation of an outer (or right) part of the second rising part 16*e* located outside a bend line K of the second rising part 16*e* when the distal contact part 16*a* is subjected to a horizontal leftward force, as shown in FIG. 5. As a result, the distal contact part 16*a* is movable leftward (or in the direction of arrow L in FIG. 5) as shown by two-dot chain line.

On the other hand, when a horizontal rightward external force is applied to the distal contact part 16*a* during detachment of the needle thread 9 from the thread hooking part 15*b*, the horizontal plate part 16*c* is rotatively moved by elastic deformation of an outer (or right) part of the second rising part 16*e* located outside the bend line K of the second rising part 16*e* when the distal contact part 16*a* is subjected to a horizontal leftward force. As a result, the distal contact part 16*a* is movable rightward (or in the direction of arrow R in FIG. 5) as shown by two-dot chain line. Consequently, the elongate hole 16*h* of the plate 16*c* is formed into an arc shape about the bent line K.

Moreover, when the horizontal plate part 16*c* is rotatively moved counterclockwise to a large extent during the hooking of the needle thread 9 on the thread hooking part 15*b*, the sewing needle 6 abuts against a right stopper edge 16*m* (corresponding to a stopper part) of the elongate hole 16*h*, whereby the a range of rotative movement (movement range) of the horizontal plate part 16*c* is limited. Thus, the distal contact part 16*a* is adapted to be prevented from detachment from the thread hooking part 15*b*.

The needle bar thread guide 10 operates as follows. An operator manually passes the needle thread 9 supplied from a thread spool (not shown) through a thread tension regulator (not shown), a thread take-up spring and the needle thread take-up 8, then being hooked on the needle bar thread guide 10. In this case, the operator holds the needle thread 9 extending from the needle thread take-up 8 toward the eye 6*a* of the sewing needle 6 by his or her one hand, moving the needle thread 9 leftward. In this instance, as shown in FIG. 9A, the needle thread 9 fed from the needle thread take-up 8 is brought into contact with the front end of the needle bar connecting stud 11 and guided by the thread guide part 15*e* so as to be moved leftward through the space defined between the horizontal plate part 16*c* and the thread hooking part 15*b* while being somewhat bent into a zigzag shape. The needle thread 9 is then engaged with the right curved edge of the thread cast-off preventing part 16*b*. In this case, as shown in FIG. 9B, the horizontal plate part 16*c* is rotatively moved counterclockwise with the leftward movement of the needle thread 9 since the horizontal plate part 16*c* is horizontally rotatable.

The distal contact part 16*a* formed on the distal end of the thread cast-off preventing part 16*b* is in contact with the upper surface of the thread hooking part 15*b*. Since the distal contact part 16*a* is formed so as to be downwardly curved and so as to be elastically deformable upward, the horizontal plate part 16*c* is elastically deformed in the direction of rotative movement, and furthermore, the distal contact part 16*a* is elastically deformed upward such that the thread cast-off preventing part 16*b* is lifted upward. Consequently, the needle thread 9 readily passes through the space defined between the distal contact part 16*a* and the thread hooking part 15*b* thereby to be guided into the thread hooking part 15*b* as shown in FIG. 9C. As a result, the needle thread 9 is thus hooked on the needle bar thread guide 10 completely.

Figure 9D:
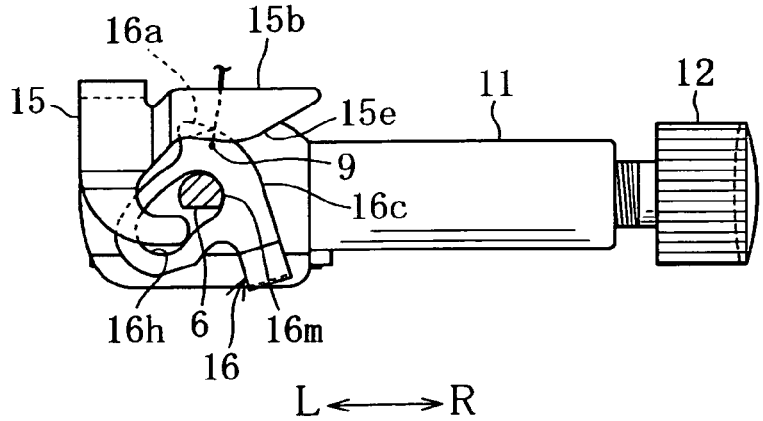
FIG. 9D is a view similar to FIG. 3, showing the condition in the case where a horizontal plate part turns largely during the thread hooking.

Even when the horizontal plate part 16*c* is moved counterclockwise to a large extent, the proximal end of the needle 6 abuts against the right stopper edge 16*m* of the elongate hole 16*h* such that the range of rotative movement of the horizontal plate part 16*c* is limited, whereupon the distal contact part 16*a* can is prevented from disengaging from the thread hooking part 15*b*, as shown in FIG. 9D.

After the needle thread 9 has been guided onto the thread hooking part 15*b*, the horizontal plate part 16*c* is returned to the original position and the thread guide part 15*e* is closed by the thread cast-off preventing part 16*b*. Moreover, the distal contact part 16*a* is brought into point contact with the upper surface of the thread hooking part 15*b*. Accordingly, even when the needle thread 9 extending from the needle thread take-up 8 toward hops or jumps while being moved from the needle thread take-up toward the needle eye during sewing, thereby swinging widely, there is no possibility of disengagement of the needle thread 9 from the needle bar thread guide 10. Consequently, the needle thread 9 can reliably be prevented from disengaging from the needle bar thread guide 10.

Figure 10A:
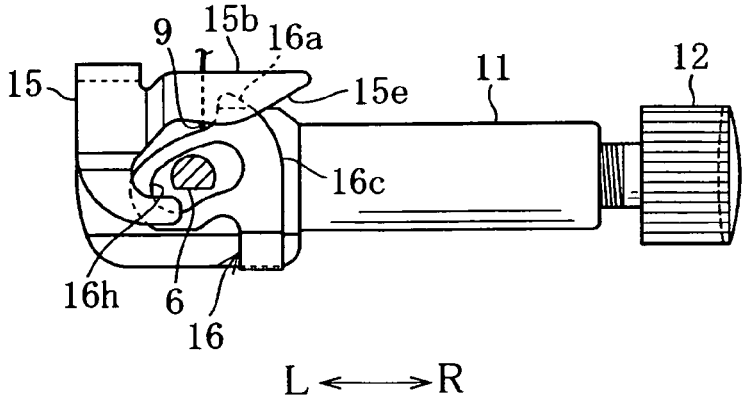
FIG. 10A is a view similar to FIG. 3, showing the condition in the case where the thread disengagement starts.
Figure 10B:
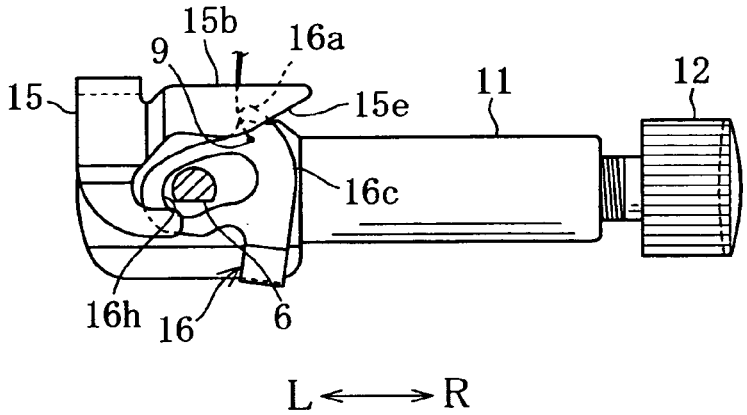
FIG. 10B is a view similar to FIG. 3, showing the condition in the case where the thread disengagement is under execution.

On the other hand, when the needle thread 9 is to be disengaged from the needle bar thread guide 10 in the case of use-up of the thread or exchange of threads, the operator holds the needle thread 9 extending from the needle thread take-up 8 toward the needle eye 6*a*, with his or her hand. In this case, as shown in FIG. 10A, the needle thread 9 from the needle thread take-up 8 is in contact with the front end of the needle bar connecting stud 11 and is in engagement with the left curved edge of the thread cast-off preventing member 16, as shown in FIG. 10A. In this case, since the horizontal plate part 16*c* is rotatable horizontally as described above, the horizontal plate part 16*c* is rotatively moved clockwise with rightward movement of the needle thread 9, as shown in FIG. 10A. Meanwhile, even when the horizontal plate part 16*c* is rotatively moved counterclockwise to a large extent, the proximal end of the needle 6 abuts against the left stopper edge 16*n* of the elongate hole 16*h* such that the rotative movement range of the horizontal plate part 16*c* is limited. As a result, the distal contact 16*a* is not disengaged from the thread hooking part 15*b*.

Figure 10C:
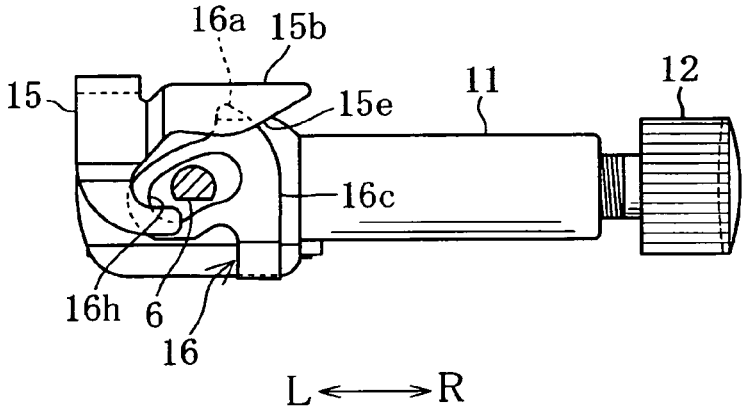
FIG. 10C is a view similar to FIG. 3, showing the condition in the case where the thread disengagement has been completed.
Figure 10D:
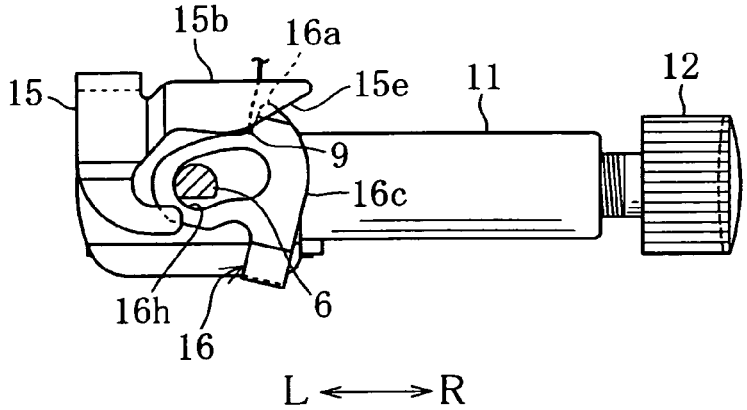
FIG. 10D is a view similar to FIG. 3, showing the condition in the case where a horizontal plate part turns largely during the thread disengagement.

The distal contact 16*a* formed on the distal end of the thread cast-off preventing part 16*b* is in point contact with the upper surface of the thread hooking part 15*b*. However, since the distal contact 16*a* is formed so as to be downwardly curved and elastically deformable upward, the horizontal plate part 16*c* is elastically deformed in the direction of rotative movement and the distal contact 16*a* is elastically deformed upward, whereupon the thread cast-off preventing part 16*b* is raised upward. As a result, the needle thread 9 is readily caused to pass through the space between the distal contact 16*a* and thread hooking part 15*b*, whereupon the needle thread 9 disengages outward from the needle bar thread guide 10, as shown in FIG. 10C. Consequently, the needle thread 9 is completely disengaged from the needle bar thread guide 10.

Thus, since the distal contact 16*a* of the thread cast-off preventing part 16*b* is in contact with the upper surface of the thread hooking part 15*b*, the distal contact part 16*a* of the thread cast-off preventing part 16*b* is readily raised against elastic force when the thread hooking part 15*b* is threaded with the needle thread 9 extending from the needle thread take-up 8 toward the needle eye 6*a* by the operator while the needle thread 9 is moved through the thread guide part 15*c* to the thread hooking part 15*b*. As a result, the needle thread 9 readily enters the thread guide part 15*e* while avoiding the thread cast-off preventing part 16*b* and accordingly, the threading work can be simplified greatly.

Furthermore, even when the needle thread 9 hops or jumps while being moved from the needle thread take-up 8 toward the needle eye 6*a* during sewing, thereby swinging widely, there is no possibility of disengagement of the needle thread 9 from the needle bar thread guide 10 since the distal contact 16*a* of the thread cast-off preventing part 16*b* is normally in contact with the upper surface of the thread hooking part 15*b*. Consequently, the needle thread 9 can reliably be prevented from disengaging from the needle bar thread guide 10.

Furthermore, even when the needle thread 9 is to be disengaged from the thread hooking part 15*b*, the distal contact part 16*a* of the thread cast-off preventing part 16*b* is raised against the elastic force by the movement of the needle thread 9 in the direction of thread disengagement in the same manner as in the thread hooking. As a result, the needle thread 9 is easily allowed to pass through the distal contact part 16*a*, whereupon the needle thread 9 can be disengaged from the thread hooking part 15*b*, avoiding the thread cast-off preventing part 16*b*. Consequently, the unthreading work by the operator can be simplified greatly.

Furthermore, the distal contact part 16*a* is formed so as to be downwardly curved and is in point contact with the upper surface of the thread hooking part 15*b*. Accordingly, when the thread hooking part 15*b* is to be threaded or unthreaded by the operator, the distal contact part 16*a* can easily be raised by the movement of the needle thread 9. Consequently, the threading or unthreading work can be simplified greatly. Moreover, since only the distal end of the thread cast-off preventing part 16*b* is bent, manufacture of the thread cast-off preventing member 16 can be simplified.

Furthermore, the thread cast-off preventing member 16 comprises the thin leaf spring and has the horizontal plate part 16*c* continuous to the distal contact part 16*a*, the elastically deformable rising part 16*f* extending upward from the horizontal plate part 16*c*, and the fixed plate part 16*g* continuous to the upper end of the rising part 16*f*. In this construction, these parts of the thread cast-off preventing member 16 can be made integrally with one another by pressing a thin leaf spring material. Consequently, the weight of the thread cast-off preventing member 16 can be reduced, and easiness and accuracy in the manufacture of the thread cast-off member 16 can be improved, whereby the manufacturing cost can be reduced.

Furthermore, the horizontal plate part 16*c* of the thread cast-off preventing member 16 includes the elongate hole 16*h* limiting a moving range of the horizontal plate part 16*c* so that the distal contact part 16*a* is prevented from disengaging from the thread hooking part 15*b* when the distal contact part 16*a* is moved horizontally by subjection to an external force. Consequently, the moving range of the horizontal plate part 16*c* can reliably be limited by the right and left stopper edges 16*m* and 16*n* in the threading or unthreading operation, and the distal contact 16*a* can reliably be maintained in contact with the thread hooking part 15*b*. Additionally, the horizontal plate part 16*c* has the elongate hole 16*h* which is formed therethrough. Consequently, the thread cast-off preventing member 16 can easily be manufactured since only the elongate hole 16*h* is formed through the horizontal plate part 16*c* by pressing.

Figure 11:
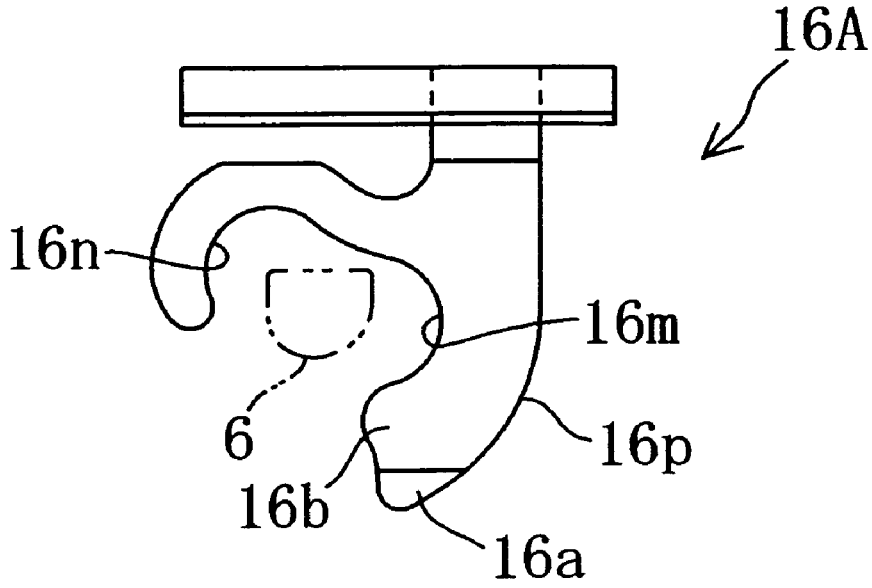
FIG. 11 is a view similar to FIG. 7, showing a second example of the present invention.

FIG. 11 illustrates a second embodiment of the invention. Identical or similar parts in the second embodiment are labeled by the same reference symbols as those in the first embodiment and the description of these parts will be eliminated. The second embodiment differs from the first embodiment in the shape of the thread cast-off preventing member. A part of the plate portion defining the elongate hole 16*h* in the horizontal plate part 16*p* is cut off and moreover, the distal end of the thread cast-off preventing part 16*b* is formed with the downwardly curved distal contact part 16*a*, as shown in FIG. 11. In this case, the elongate hole 16*h* includes the right and left stopper edges 16*m* and 16*n* against which the sewing needle 6 abuts, too. Accordingly, even when the horizontal plate part 16*p* is rotatively moved clockwise or counterclockwise to a large extent, the moving range of the horizontal plate part 16*p* is limited, whereupon the distal contact part 16*a* can be prevented from disengaging from the thread hooking part 15*b*.

Figure 12:
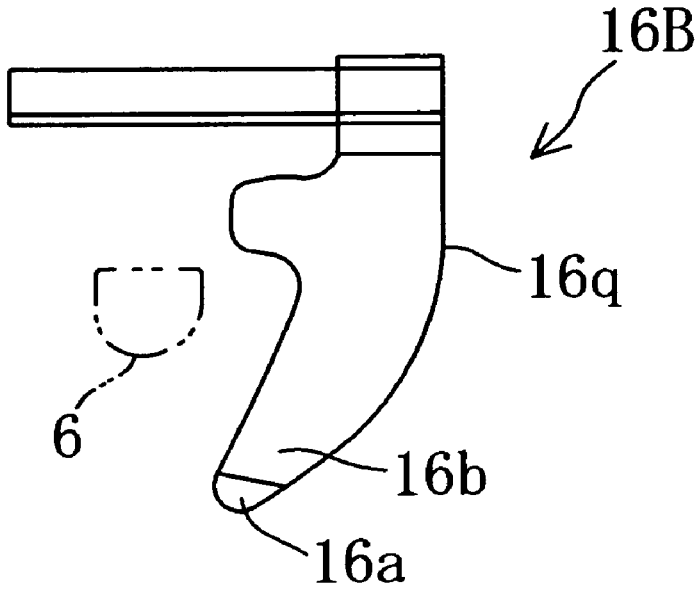
FIG. 12 is a view similar to FIG. 7, showing a third example of the present invention.

FIG. 12 illustrates a third embodiment of the invention. Identical or similar parts in the second embodiment are labeled by the same reference symbols as those in the first embodiment and the description of these parts will be eliminated. The third embodiment also differs from the first embodiment in the shape of the thread cast-off preventing member. A generally crescent-shaped thread cast-off preventing part 16*b* is formed on the horizontal plate part 16*q* of the thread cast-off preventing member 16B as shown in FIG. 12. The thread cast-off preventing part 16*b* has the downwardly curved distal contact part 16*a*. In this case, the shape of the thread cast-off preventing part 16*b* facilitates threading with the needle thread 9.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A needle bar thread guide for a sewing machine which includes a needle bar supporting a sewing needle with a lower end and a thread hooking member provided on the lower end of the needle bar to hook a needle thread, the thread hooking member including a thread hooking part with an upper surface, the needle bar thread guide comprising:

a thread guide part provided in the thread hooking part of the thread hooking member to guide the needle thread into the thread hooking part; and a thread cast-off preventing member having a thread cast-off preventing part closing the thread guide part, the thread cast-off preventing member being elastically deformable, the thread cast-off preventing part having a distal end which is in contact with the upper surface of the thread hooking part.

2. The needle bar thread guide according to claim 1, wherein when the needle thread is moved through the thread guide part to the thread hooking part, the thread cast-off preventing member is elastically deformed so that the needle thread is moved into the thread guide part thereby to be hooked by the thread hooking part.

3. The needle bar thread guide according to claim 1, wherein the distal end of the thread cast-off preventing part is formed so as to be curved downward and is in point-contact with the upper surface of the thread hooking part.

4. The needle bar thread guide according to claim 1, wherein the thread cast-off preventing member comprises a leaf spring and has a horizontal plate part continuous to the distal end of the thread cast-off preventing part, an elastically deformable rising part extending upward from the horizontal plate part and having an upper end, and a fixed plate part continuous to the upper end of the rising part.

5. The needle bar thread guide according to claim 4, wherein the horizontal plate part of the thread cast-off preventing member includes a stopper part limiting a moving range of the horizontal plate part so that the distal end of the thread cast-off preventing part is prevented from disengaging from the thread hooking part when the distal end of the thread cast-off preventing part is moved horizontally.

6. The needle bar thread guide according to claim 5, wherein the horizontal plate part has an elongate hole which is formed through the horizontal plate part so that the needle is passed through the hole, and the stopper part is comprised of an edge of the elongate hole.

* * * * *